United States Patent [19]

Okano et al.

[11] 4,114,323

[45] Sep. 19, 1978

[54] DEVICE FOR AUTOMATICALLY LAPPING WEDGE-GATE VALVE SEAT

[75] Inventors: Masami Okano; Shozo Yoshitomi, both of Kita-kyushu, Japan

[73] Assignee: Okano Valve Seizo Kabushiki Kaisha, Kita-kyushu, Japan

[21] Appl. No.: 729,603

[22] Filed: Oct. 4, 1976

[30] Foreign Application Priority Data

Oct. 13, 1975 [JP] Japan ..... 50-122419

[51] Int. Cl.[2] ..... B24B 19/00

[52] U.S. Cl. ..... 51/241 VS

[58] Field of Search ..... 51/241 VS, 241 A, 241 S; 90/12.5

[56] References Cited

U.S. PATENT DOCUMENTS

| | | | |
|---|---|---|---|
| 1,993,844 | 3/1935 | Karnath | 51/241 VS |
| 2,723,512 | 11/1955 | Gibson et al. | 51/241 A |
| 4,000,584 | 1/1977 | Uyetake | 51/241 VS |

*Primary Examiner*—Harold D. Whitehead
*Assistant Examiner*—Roscoe V. Parker
*Attorney, Agent, or Firm*—Wenderoth, Lind & Ponack

[57] ABSTRACT

A device for automatically lapping a wedge-shaped gate valve seat has a main frame including a flange disposed on its upper end portion and a guiding unit disposed on its lower portion. With the flange disposed upon a valve body of the gate valve, either of the valve seats is opposed to a lapping plate rotatably disposed within the guiding unit. The plate intimately contacts the valve seat through the operation of a fluid cylinder and laps it while simultaneously rotating and revolving. Devices for supplying a lapping agent, wiping it and sensing the state of the lapped seat are disposed within the guiding unit and are movable to their operating position. The seat can also be observed through a periscopic observation glass extending through the main frame.

2 Claims, 4 Drawing Figures

DEVICE FOR AUTOMATICALLY LAPPING WEDGE-GATE VALVE SEAT

BACKGROUND OF THE INVENTION

This invention relates to a device for automatically lapping valve seats and more particularly to such a device suitable for repairing wedge-shaped gate valve seats and the like used in atmospheres highly contaminated with radioactive substances in nuclear power plants or the like.

Nuclear power plants are subject to legal periodic inspections at predetermined time intervals. Under these circumstances it is frequently required to lap valve seats in order to tailor the particular plant to such an inspection or upon repairing wedge-shaped gate valve seats and other valve seats as a result of the inspection. The lapping operation has been previously necessary to be manually performed. Therefore only after the radiation level within the particular nuclear reactor has been reduced to its permissible value or less, are repair personnel permitted to enter that nuclear reactor to perform the operation of lapping valve seats, and then only for a time period as short as possible. It has been previously said that the radiation dose received in each operation is inversely proportional to the square of the distance from a contamination source involved and also such a radiation dose is proportional to the working hours. Therefore the same operator can not work for a long time and the exposure dose of the operator restricts his working hours. This has unavoidably led to the shift of repair personnel afer short working hours for the control of their health and accordingly to the necessity of securing much skilled labor.

On the other hand, devices for lapping valve seats have been previously proposed. Most of the proposed lapping devices have been of the manually operated type although some of the devices have been of the power operated type. In either type of conventional lapping devices a valve seat to be lapped has been coated with a lapping agent and centered on the lapping plate. Then the lapping plate has been rotated with a predetermined rotational force with respect to the valve seat thereby to lap the latter by the lapping agent. However those devices have been of such a structure that the pressure applied to the interface of the valve seat and the lapping plate does not remain unchanged and also can not be adjusted in accordance with the area of the particular valve seat and for each cycle of the lapping operation the lapping agent is supplied to the valve seat being lapped or the next valve seat after the removal of the lapping plate. It is desirable to provide a device for automatically lapping valve seats operated from a remote position. This is particularly desirable for lapping valve seats used in a nuclear reactor because jobs performed within the reactor are not desirable from the standpoint of the health of the operators.

SUMMARY OF THE INVENTION

Accordingly it is an object of the present invention to provide a new and improved device for automatically lapping the valve seat of wedge-shaped gate valves which device can be operated from a remote position and which eliminates the necessity of manually performing the operation within the associated nuclear reactor.

The present invention accomplishes this object by the provision of a device for automatically lapping a wedge-shaped gate valve seat, comprising, in combination, a main frame including a flange for attaching the lapping device to a valve body of the gate valve having an inlet and an outlet wedge-shaped valve seats, and a guiding unit extending into the valve body so as to be located between and be opposed to the pair of valve seats, a lapping plate movably disposed within the guiding unit, driving means within the guiding unit effecting a combined rotating and revolving movement of the lapping plate, and means within the guiding unit for moving the lapping plate in the axial direction of the movement to push against one of the valve seats.

The guiding unit preferably includes therein a lapping agent feeder provided with operating means in the guiding unit and radially movable to coat a lapping agent on the one valve seat, a cleaning wiper including a rotatable wiping member capable of being interposed between the lapping plate and the valve seat, a leakage sensor in compressive contact with the one valve seat through the lapping plate to automatically sense the lapped state of the valve seat through the utilization of a fluid pressure, and a periscope type observation glass extending through the guiding unit and having an extremity reaching adjacent to the one valve seat.

The driving means can advantageously include an externally driven pinion having an outer periphery engaging an internal gear effecting a circular rotational movement and an inner periphery engaging an external gear having a ring effecting an eccentric rotational movement, and a transmission ring for transmitting a combination of the circular rotational movement of the internal gear and the eccentric rotational movement of the ring on the external gear to the lapping plate.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
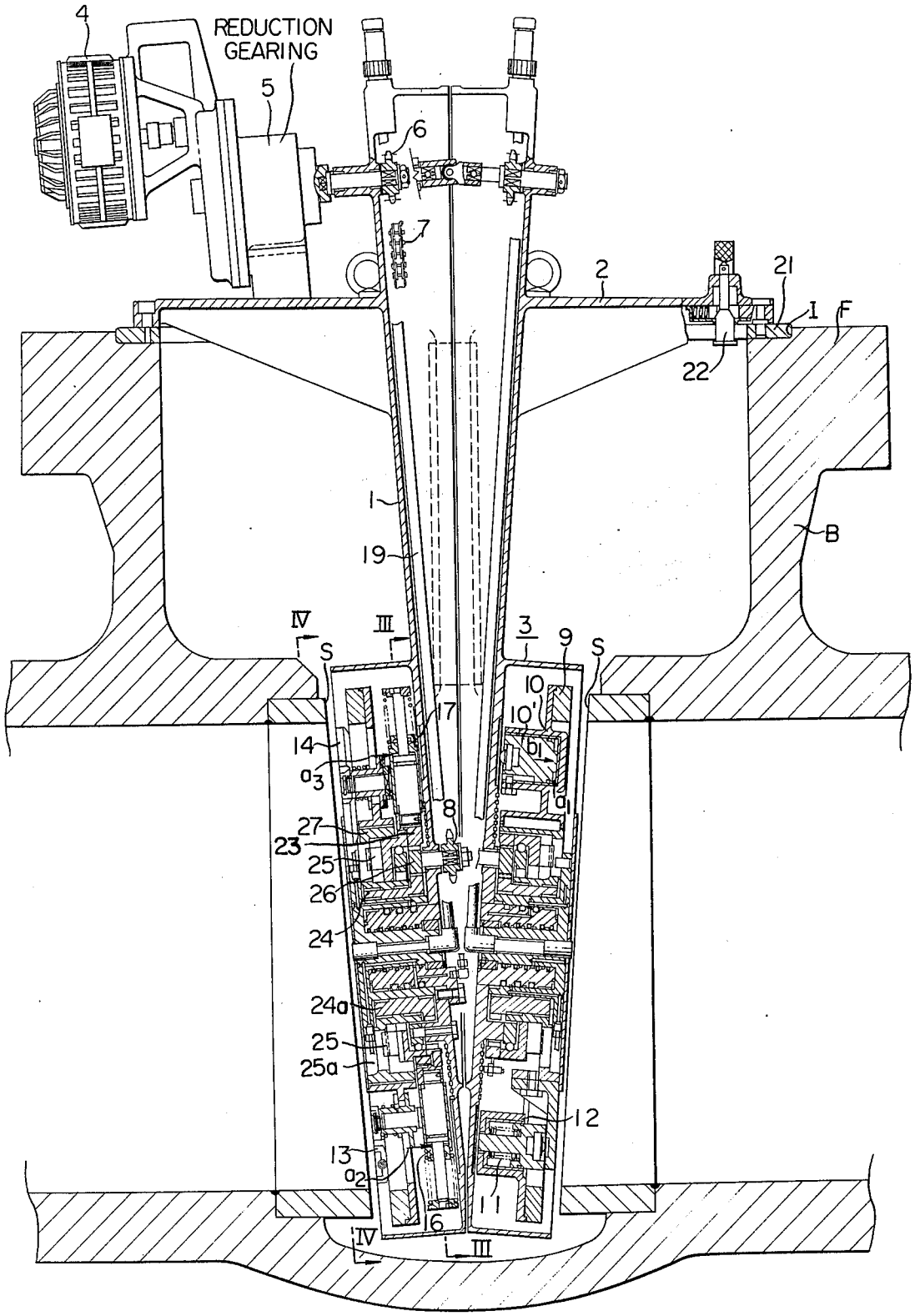
FIG. 1 is a longitudinal sectional view, part of which is taken along line I—I of FIG. 3 and partly in elevation, of a device for automatically lapping a wedge-shaped valve seat of a gate valve constructed in accordance with the principles of the present invention.
Figure 3:
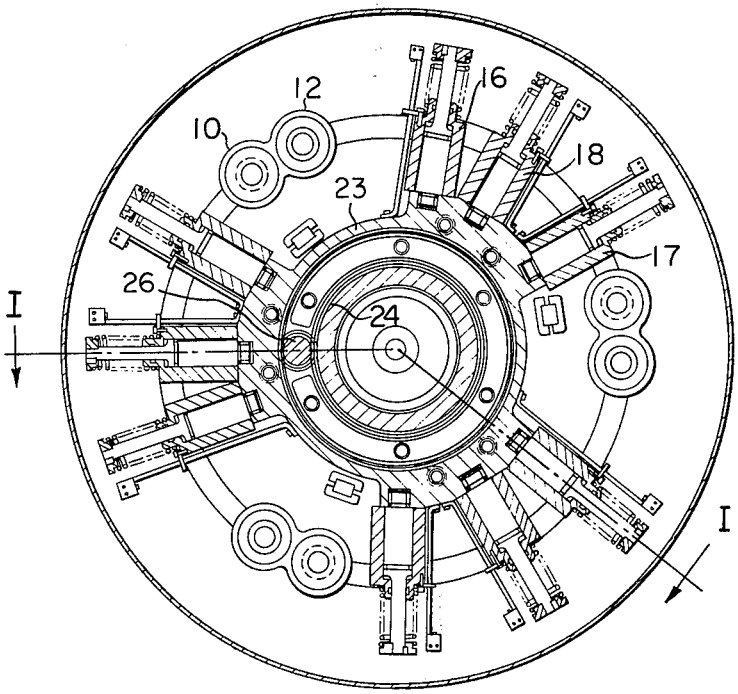
FIG. 3 is a cross sectional view of the guiding unit shown in FIGS. 1 and 2 with the section taken along the line III—III of FIG. 1.

While the present invention is applicable to a variety of gate valves it is particularly suitable for use in lapping a wedge-shaped valve seat of a gate valve within containers having housed therein nuclear reactors. Thus the present invention will now be described in detail with such a gate valve. An embodiment of the present invention illustrated in FIG. 1 comprises a main frame generally designated by the reference numeral 1 including a flange 2 in the form of a disc disposed on the upper end portion thereof, and a guiding unit generally designated by the reference numeral 3 and disposed on the lower portion thereof. The frame 2 serves to attach the entire device of the present invention to a valve body B including therein a pair of inlet and outlet valve seats S to be lapped after an associated valve parts (not shown) has been removed from the valve body B. The guiding unit 3 has housed in and supported on each of bilateral portions thereof a lapping plate and other components as will be described later. With the flange 2 attached to the valve body B, the guiding unit 3 is arranged to extend through the valve body B until its lower end reaches adjacent to the lowermost portion of the valve seats. The guiding unit 3 is formed integrally with the flange 2 so that all the components, disposed within each of the bilateral portions thereof with the same slope relative to the longitudinal axis thereof as the adjacent valve seat S are introduced into the space formed between the opposite valve seats S.

The main frame 1 has a combination of an electric reversible motor 4 and a reduction gearing 5 fixedly secured to the upper surface of the flange 2, as viewed in FIG. 1 and a chain sprocket wheel 6 is disposed within the main frame 1 so as to be driven by the motor 4 through the reduction gearing 5. Then an endless chain 7 (only a part of which is illustrated in FIG. 1) is connected between the chain sprocket wheel 6 and another chain sprocket wheel 8 disposed within the guiding unit 3 to transmit the rotational movement of the upper sprocket wheel 6 to the lower sprocket wheel 8.

Each of the bilateral portions of the guiding unit 3 further has an annular lapping plate 9 rotatably carried therein and adapted to push against the valve seat S under a suitable surface pressure by a plurality, in this case three, pressurized fluid cylinders 10 disposed at substantially equal angular intervals and driven through the chain sprocket wheel 8. In the absence of a fluid pressure applied to the cylinders 10, the lapping plate 9 is returned to its inoperative position through the operation of pressuized fluid cylinders 12 and the holding springs 11 juxtaposed with the respective cylinders 10.

Figure 4:
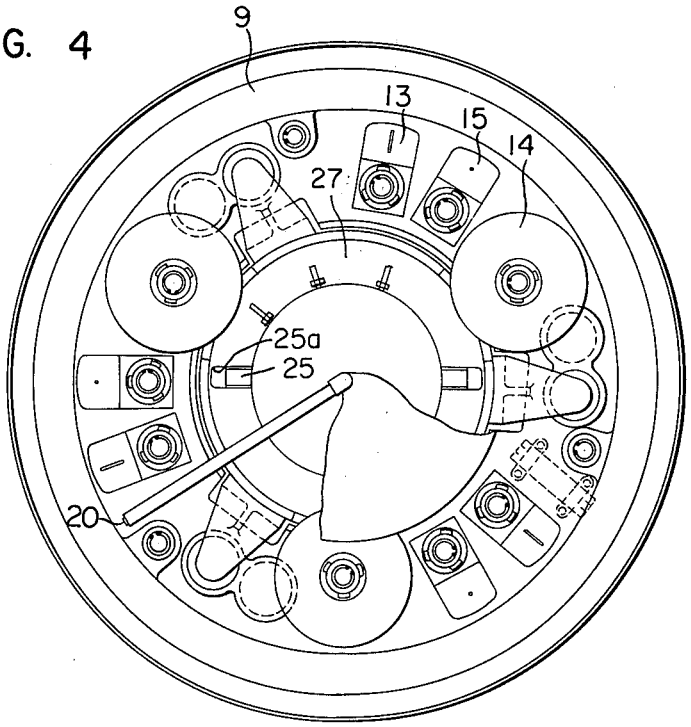
FIG. 4 is a front elevational view of the guiding unit as viewed along the line IV—IV of FIG. 1 in the direction of the arrows shown in FIG. 1.

The guiding unit 3 also include automatic lapping agent feeders 13, cleaning wipers 14 and leakage sensors 15 disposed radially inwardly of the lapping plate 9. In FIG. 4 three triads of feeders 13, wipers 14 and the sensors 15 are shown as being radially disposed with these components 13, 14 and 15 of each triad juxtaposed with one another. The lapping agent feeder 13 automatically feeds a lapping agent to the associated valve seat and the cleaning wiper 14 serves to wipe the lapping agent off that valve seat S. The leakage sensor 15 serves to automatically sense the lapped condition of the valve seat S. The automatic feeders 13, the wipers 14 and the leakage sensor 15 are operatively connected to their own pressurized fluid cylinders 16, 17 and 18 with return springs respectively so as to be radially moved to below the lapping plate 9 through the operation of those cylinders thereby to be pushed against the valve seat S. Then the feeders 13, the wipers 14 and the sensor 15 perform their own operations.

As shown in FIG. 1, a pair of periscope type observation glasses 19 extend in opposite relationship through the main frame 1 and the guiding unit 3 and have the respective upper ends slightly projecting from the upper end of the main frame 1. The lower ends of the observation glasses 19 reach the vicinity of the inner periphery of the lower side of the lapping plate 9.

Further, the flange 2 of the main frame 1 is provided on the outer peripheral portion with a centering ring 21 and clamping means 22 permitting the one-step operation of fixing and removing the device to and from the valve body. The centering ring 21 is fitted into an associated groove I formed in the flange F of the valve body B with a predetermined tolerance to locate the lapping plate 9 in its proper position relative to the valve seat S.

The arrangement as above described is operated as follows: after an associated valve part has been removed from the valve body B, the flange 2 is disposed on the flange F of the valve body B with the centering ring 21 fitted into the annular recess I on the flange F of the valve body B. At that time the lapping plates 9 are located in their proper position relative to the valve seats S. Then the clamping means 22 cooperates with the weight of the device to fixedly secure the main frame to the valve body through a one-step operation. This eliminates the necessity of performing any operation requiring touching the components such as bolting.

With the device attached to the valve body as above described, the lapping plates 9 are positioned adjacent to the valve seats S. Therefore the lapping plates 9 can be slightly moved in the axial direction to contact the lower surface thereof with the adjacent valve seats S. This slight movement of the lapping plate 9 is accomplished by supplying a working fluid such as air or nitrogen gas to the pressurized fluid cylinders 10 to the space *a*1 in FIG. 1. The pressure of the fluid or gas is exerted on the ends of the associated cylinders 10 to move the cylinders 10 in the direction of the arrow *b*1 shown in FIG. 1. Therefore the holding springs 11 are compressed to permit the corresponding lapping plate 9 to be axially moved until it is in intimate contact with the adjacent valve seat S. It will be understood that, by controlling a fluid pressure applied to the cylinders 10 through a suitable electromagnetic valve or adjusting valve (not shown), a surface pressure at which the lapping plate pushes against the valve seat S can be adjusted to any desired magnitude.

While the lapping plate 9 is maintained against the valve seat S under the desired surface pressure, the reversible motor 4 is energized to rotate the lapping plate 9 in either one of the opposite directions through the reduction gearing 5, the sprocket wheels 6 and 8 and the endless chain 7.

The rotational movement transmitted to the sprocket wheel 8 is transmitted to a pinion 26 (see FIG. 1). This pinion 26 transmits its rotational movement to an internal gear 23 at the outer periphery thereof and simultaneously to an external gear 24 at the inner periphery thereof. The internal gear 23 effects a circular rotational movement of the lapping plate 9 while the external gear 24 has an eccentric portion 24*a* for effecting an eccentric rotational movement. The rotational movement of gear 23 is transmitted to a transmission ring 27 by a pin and slot connection 25, 25*a* to rotate the ring 27 about its axis while it is reciprocated transversely to the axis of gear 24 by the eccentric portion 24*a* rotating within the center of ring 27. That is, the transmission ring 27 effects a combination of rotating and revolving movements. This movement of the transmission ring 27 is imparted to the lapping plate 9 which is mounted thereon to cause the movement thereof identical to that of the transmission ring 27.

As for gate valves having wedge-shaped inlet and outlet valve seats in the form of plain surfaces, it is difficult to lap the valve seats into plain surfaces unless the lapping plate laps the valve seat while it is simultaneously rotated and revolved. The present invention eliminates this difficulty by the provision of a lapping plate adapted to contact and lap the valve seat to be lapped while it continues to be simultaneously rotated and revolved. It will be appreciated that the lapping plate has a rotational speed capable of being continuously changed by means of the reduction gearing 5, if desired.

Before the lapping plate 9 is put in intimate contact with the valve seat S and driven, a working fluid is supplied to the space *a*2 (see FIG. 1) in the cylinders 16 for the lapping agent feeders 13 located radially inwardly of the lapping plate to move those cylinders radially outwardly thereby to move the feeders 13 to the lapping interface of the lapping plate 9 and the valve seat S. Then the feeders 13 are rotated while they deliver a lapping agent to that interface with the pressure of the working medium adjusted to a suitable value, for example by an electromagnetic valve (not shown). In this way the lapping agent is supplied to the lapping interface while the lapping plate 9 performs the operation of lapping the valve seat S.

After the completion of the particular lapping operation, it is necessary to remove the lapping agent from the valve seat S. Alternatively it may be required to do so during the course of the lapping operation. In this case, the cleaning wipers 14 are moved radially outwardly by supplying a working fluid to the space *a*3 in the cylinders 17 in FIG. 1. Thereby a wiping member in the form of a disc included in the cleaning wipers 14 abuts the valve seat S. Simultaneously the wiping member is moved along the valve seat to clean the entire area of the valve seat. It is noted that for each reciprocating movement of the wiper the wiping member effects a quarter of one complete rotation whereby a new cleaning surface thereof is ready for the succeeding cleaning operation.

Figure 2:
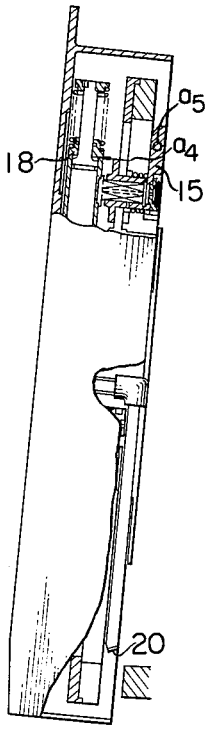
FIG. 2 is a fragmental side elevational view of the guiding unit shown in FIG. 1 with parts broken away and with parts illustrated in longitudinal section different from that taken for FIG. 1.

After the completion of each lapping operation it is preferable to inspect the planeness of the valve seat which has been lapped to determine the sealing ability thereof. To this end, the leakage sensors 15 have been provided. Like the feeders 13 and the wipers 14, the leakage sensors 15 can be moved radially outwardly by supplying a working fluid to the space *a*4 in the cylinders 18 (see FIG. 2) in FIG. 2. Thereby the sensors 15 are brought under the lapping plate and put in operation. The leakage sensors 15 are based upon the principle that it includes a contact surface slightly larger than the width of the valve seat and a small opening *a*5 through which a fluid at a constant fluid pressure is caused to flow to the valve seat as shown in FIG. 2. In the presence of scratches and/or irregulates on the lapped valve seat, a change in pressure occurs due to the escape of the fluid from such defective area or areas of the valve seat. This change in pressure provides a measure of the sealing ability of the lapped valve seat.

On the other hand whether or not the finished state of the valve seat has been achieved by the particular lapping operation can be determined by directly observing it. As above described, each of the periscope type observation glasses 19 extends through the main frame 1 until its extremity 20 is adjacent to the associated valve seat. This measure permits the valve seat to be observed from a remote position. If desired, a photographic camera may be operatively associated with either of the observation glasses to photograph the valve seat. Alternatively a television camera may be utilized in conjunction with the observation glasses.

Since the lapping device of the present invention is used with gate valves with wedge-shaped seats, the inlet and outlet valve seats are required to be lapped. Therefore an electromagnetic clutch or the like (not shown) can be disposed in the reduction gearing 5 in order to simultaneously lap both valve seats or to lap the valve seats one after the other.

From the foregoing it is seen that in the lapping device of the present invention all operating means effecting movements are capable of being controlled by fluid pressure means, electrical means or both means. Therefore the operator can perform all the necessary operations required for lapping valve seats by remote operation without directly touching the valve body and the device. Accordingly it is possible to avoid the danger that the operator may be exposed to radiation. Further the present invention is extremely advantageous from the standpoint of economy because of the elimination of the necessity of performing a manual operation requiring many shift operators.

While the present invention has been illustrated and described in conjunction with a single preferred embodiment thereof it is to be understood that various changes and modifications may be resorted to without departing from the spirit and scope of the present invention.

What we claim is:

1. A device for automatically lapping a wedge-shaped gate valve seat, comprising, in combination, a main frame having a flange for attaching the lapping device to a valve body of a gate valve having wedge-shaped inlet and outlet valve seats, and a guiding unit extending into the valve body for positioning between and opposed to said pair of valve seats, at least one lapping plate disposed within said guiding unit, driving means within said guiding unit for driving said lapping plate in a combined rotating and eccentric movement relative to the axis of rotation of said lapping plate in said rotating movement, means within said guiding unit for moving said lapping plate in the axial direction of said rotating movement for urging said lapping plate against one of said valve seats, lapping agent feeders in said guiding unit and having operating means for moving said feeders radially and coating a lapping agent on said one valve seat, cleaning wipers in said guiding unit each having a rotatable wiping member and wiping member moving means for interposing said wiping member between said lapping plate and said valve seat, leakage sensors in said guiding unit and leakage sensor moving means for moving said leakage sensors into compressive contact with said valve seat for automatically sensing whether said one valve seat has been satisfactorily lapped by the utilization of a fluid pressure, and a periscope type observation glass extending through said guiding unit and having an extremity extending to a position adjacent said one valve seat.

2. A device as claimed in claim 1 wherein said driving means includes an externally driven pinion, an internal gear for effecting the rotational movement and an external gear having an eccentric portion for effecting the eccentric movement, said pinion being meshed with said gears, and a transmission ring connected between said gears and said lapping plate for transmitting a combination of said rotational movement of said internal gear and said eccentric movement of said ring to said lapping plate.

* * * * *